United States Patent [19]

Hutson et al.

[11] Patent Number: 4,567,738

[45] Date of Patent: Feb. 4, 1986

[54] STRUCTURAL FABRIC AND METHOD FOR MAKING SAME

[75] Inventors: Harold K. Hutson; Ronald G. Krueger, both of Seguin, Tex.

[73] Assignee: Knytex, Inc., Minneapolis, Minn.

[21] Appl. No.: 210,852

[22] Filed: Nov. 26, 1980

[51] Int. Cl.[4] ..... D04B 23/06

[52] U.S. Cl. ..... 66/85 A; 66/84 A; 28/157; 26/51.3; 112/440

[58] Field of Search ..... 66/85 A, 84 A, 196; 28/143, 101, 102, 100, 157; 26/51.3; 112/440

[56] References Cited

U.S. PATENT DOCUMENTS

| | | | |
|---|---|---|---|
| 2,890,579 | 6/1959 | Mauersberger | 66/192 |
| 3,279,221 | 10/1966 | Gliksmann | 66/192 |
| 3,321,348 | 5/1967 | Rupp | 66/84 A X |
| 3,383,278 | 5/1968 | Helland | 26/51.3 |
| 3,422,511 | 1/1969 | Seguin | 28/101 |
| 3,602,965 | 9/1971 | Burger | 28/101 |
| 3,607,565 | 9/1971 | Eaton | 28/100 |
| 3,639,954 | 2/1972 | Kirzinger et al. | 28/102 |
| 3,756,043 | 9/1973 | Kemter | 66/84 A |
| 3,950,583 | 4/1976 | Patin | 28/101 |
| 4,055,697 | 10/1977 | Schmanski | 26/51.3 |
| 4,080,232 | 3/1978 | Friedrich | 28/102 |
| 4,189,811 | 2/1980 | Cole | 66/84 A X |

FOREIGN PATENT DOCUMENTS

| | | | |
|---|---|---|---|
| 912296 | 10/1972 | Canada | 66/84 A |
| 2271326 | 12/1975 | France | 26/51.3 |
| 45-33874 | 10/1970 | Japan | 66/85 A |
| 50-35157 | 11/1975 | Japan | 28/157 |

OTHER PUBLICATIONS

Bahlo, "New Fabrics Without Weaving", Modern Textile Magazine", Nov. 1965, pp. 51–54.

*Primary Examiner*—Ronald Feldbaum
*Attorney, Agent, or Firm*—Oblon, Fisher, Spivak, McClelland & Maier

[57] ABSTRACT

A structural fabric (20, 28, 40, 48) and a method for making the same is disclosed. Structural fabric (20) is comprised of a plurality of substantially parallel, uniaxial structural yarn (22) and a secondary yarn (24) for holding the structural yarns (22) in place. The structural yarns (22) are oriented at an angle skewed from both the fabric centerline (26) and a line perpendicular to the fabric centerline (26).

A double biased fabric (28) is made by sewing two fabrics (20) together with secondary yarn (39). An alternate double bias fabric (40) is made by sewing together with secondary yarn (46) the two layers of a flattened helix made from structural yarn (42, 44) running spirally substantially the length of the fabric (40).

A triaxial fabric (48) is made by sewing together with a secondary yarn (56) two single biased fabrics (50, 52) and a layer of longitudinally-extending structural yarn pieces (54).

13 Claims, 12 Drawing Figures

FIG. 10
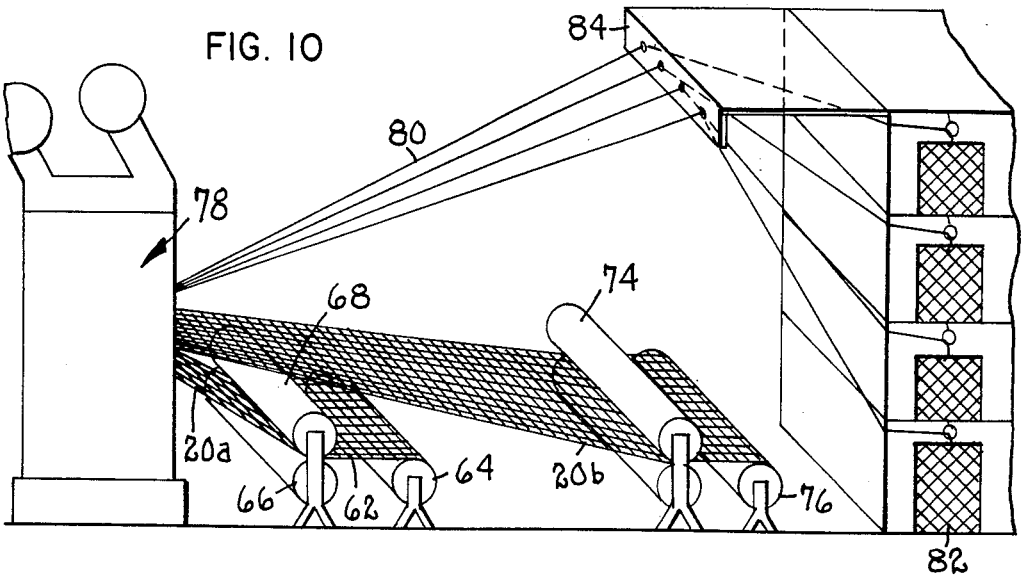
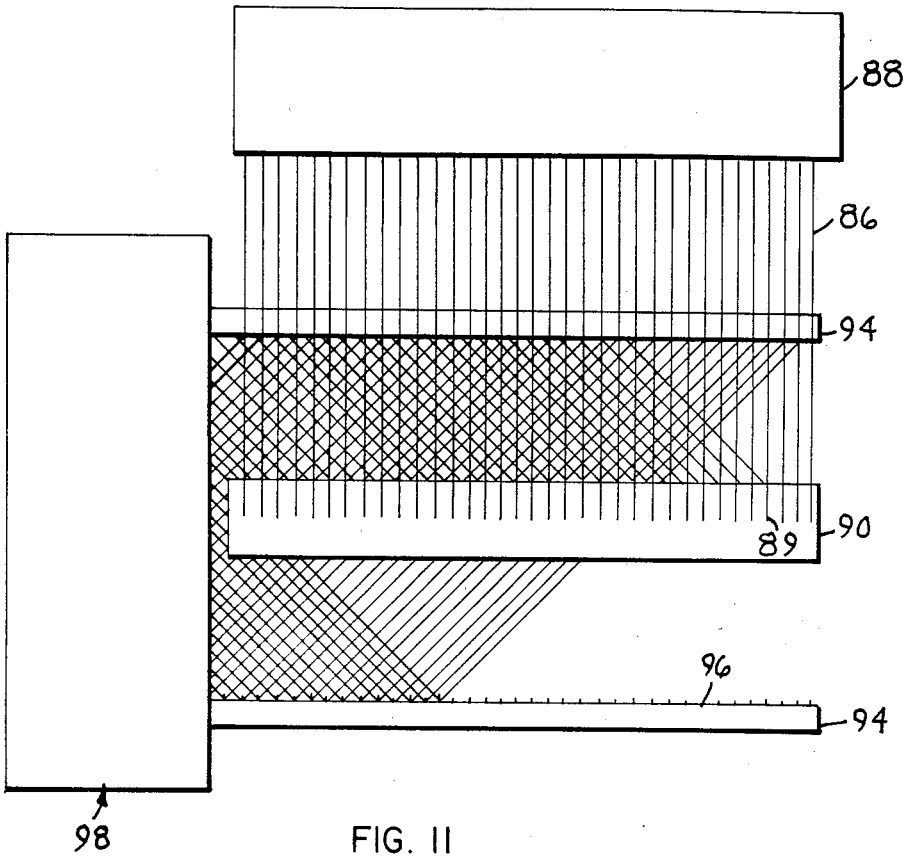
FIG. 11

STRUCTURAL FABRIC AND METHOD FOR MAKING SAME

TECHNICAL FIELD

This invention relates to a structural fabric and, more particularly, to a fabric comprised of one or more layers having uniaxial structural yarns held together by sewn or knitted secondary yarn. The invention relates also to the method for making the fabric.

BACKGROUND OF THE INVENTION

Fiberglass reinforced plastic is a relatively new engineering material. World War II initiated a demand for fiberglass reinforced plastic as a construction material in radomes, aircraft parts, and marine craft. Since then, the material has found wide use in many other applications, including automobile parts, skis, and a greater variety of military and commercial aircraft and marine parts.

The most common type of fiberglass reinforced plastic is comprised of varying ratios of glass fiber reinforcement and thermosetting polyester resins. Ordinarily, a catalyst is introduced into the resin to initiate hardening, thereby forming a solid matrix fully incapsulating the glass fibers. The resin provides chemical and corrosion resistance, durability, light weight, texture, electrical and thermal insullation, and molded-in color. The glass reinforcement contributes mechanical strength, rigidity, dimensional stability, and temperature resistance.

Fiberglass reinforcing material has been available in continuous strand, chopped strand, woven roving, and matt form. The continuous strand is a single continuous strand used in wrapping situations to provide, for example, for radial burst strength in a pressure bottle. Continuous strand may also come in fabric form wherein a plurality of parallel, uniaxial structural yarns are held together by a sewing stitch or knitting stitch which runs perpendicular to the axis of the structural yarns. A continuous or uniaxial material results in high compressive and tensile strength in one direction.

Chopped strands are short fibers oriented in all directions. A resulting laminate has equal strength in all directions. Since the fibers are less than two inches in length, however, the strength is not as great as it would be with continuous strand or woven roving.

Woven roving is used for high strength laminates having a minimal thickness requirement. Woven roving is comprised of a plurality of continuous strands running in two directions perpendicular to each other and held together by weaving the one set of strands with the other. Individual strands are not uniaxial in woven roving fabric.

Previously known reinforcing materials have been limited to fabrics having structural yarns running parallel with the centerline of the material or perpendicular to it. With the increased use and demand for fiberglass reinforced plastic, it has been found that many more applications could utilize the material if the structural yarn in the reinforcing fabric could be oriented in directions different from the Zero degree and 90 degree directions relative to the fabrics longitudinal centerline. Additionally, some applications have demanded high strength in more than one direction, yet not all directions. Hence, a need has developed for a reinforcing material which can provide variable or multiple directional strength characteristics. The present invention addresses these problems.

SUMMARY OF THE INVENTION

In its simplest form, the present invention is directed to a structural fabric having substantially parallel, longitudinal edges with a centerline therebetween comprised of a plurality of substantially parallel, uniaxial structural yarn and means for holding each of the structural yarns in place with a secondary yarn. The structural yarns are oriented at an angle skewed from both the fabric centerline and a line perpendicular to the fabric centerline. Such fabric is called biased fabric.

A composite structural fabric is comprised of a plurality of biased fabrics or layers wherein at least one of the layers includes a plurality of substantially parallel, uniaxial structural yarn. Oftentimes, the two or more layers of such a fabric are each comprised of a plurality of substantially parallel, uniaxial structural yarn. With each layer, however, the structural yarn ordinarily runs in a different direction. With this type of fabric, the holding means is comprised of secondary yarn sewn through all layers to hold the various layers of structural yarn together and in proper orientation. More commonly, a first secondary yarn is used to hold the structural yarns in each layer in place relative to each other and a second secondary yarn holds the various layers together.

In a preferred embodiment of the more complex fabric, two layers are each comprised of a biased fabric. The structural yarn in the first fabric runs at a direction 45 degrees to the fabric centerline while the structural yarn in the second fabric runs 135 degrees to the centerline. Thus, the structural yarns in the two layers cross each other at 90 degree angles. The structural yarns are held together in the individual layers by a secondary yarn which is either knitted or sewn to the structural yarns. A third layer is formed by a plurality of uniaxial structural yarns running substantially parallel to the centerline. The structural yarns of the third layer are commonly sewn with a tricot stitch to the two bias fabrics. Thus, a three-layer fabric having structural yarn running in three different directions is formed.

The present invention is particularly advantageous in that it presents the plastics engineer with the versatility of using a longitudinal fabric having structural strength according to any angle he may designate.

Even more importantly, more than one fabric offering the strength of uniaxial structural yarn may be combined to provide structural strength characteristics in several directions.

Furthermore, the weight and density of the structural yarn in any one layer may be varied with respect to that of another layer, thereby offering even more engineering possibilities.

A better understanding of these and other advantages of the present invention, as well as objects obtained by its use, may be had by reference to the drawings which form a further part hereof and to the accompanying descriptive matter in which there are illustrated and described preferred embodiments of the invention.

BRIEF DESCRIPTION OF THE DRAWINGS

FIG. 11 is an illustration of a process used to fabricate the alternate embodiment of the double bias fabric of FIGS. 5 and 6.

DETAILED DESCRIPTION OF THE INVENTION

Figure 1:
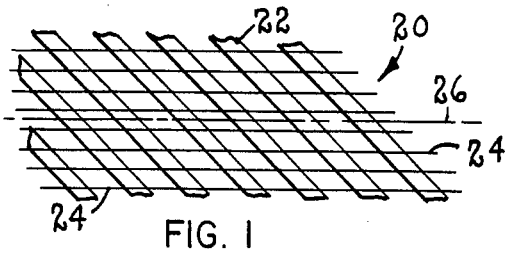
FIG. 1 is a top view of a single bias fabric in accordance with the present invention.
Figure 2:
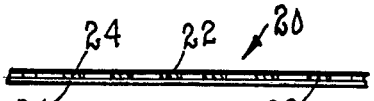
FIG. 2 is a side view of the fabric shown in FIG. 1.

Reference is now made to the drawings wherein like reference numerals designate identical or corresponding parts throughout the several views. A single biased fabric 20 is shown in FIGS. 1 and 2. Single biased fabric 20 is comprised of structural yarn 22 and secondary yarn 24. The plurality of structural yarn pieces 22 shown in FIG. 1 are spaced-apart for the sake of clarity. Ordinarily, structural yarns 22 would be adjacent to one another. All structural yarns 22 are unidirectionally oriented and are parallel to one another. Since structural yarns 22 are not weaved as in woven roven, the structural yarns 22 are uniaxial. It has been found that the uniaxial feature significantly enhances the strength characteristics of a fabric 20 in the axial direction when compared with woven prior art fabrics.

Secondary yarn pieces 24 are sewn or knitted to structural yarn pieces 22 to hold them in place with respect to each other. Secondary yarn pieces 24 ordinarily have a significantly smaller cross-sectional area than the structural yarn pieces 22. Secondary yarn pieces 24 ordinarily run substantially parallel to the centerline 26 of fabric 20 and are spaced-apart from each other. Various knitting or sewing stitches which are commonly known to those skilled in the art may be used.

Structural yarn 22 is preferably a bundle of a glass fibers, although any structural fiber, for example, carbon or commercial proprietary fibers, may be used. Secondary yarn 24 is preferably made from a similar material, although it need not be. Secondary yarn 24 is not structural since it is much smaller in cross-sectional area and much more flexible than structural yarn 22.

Figure 3:
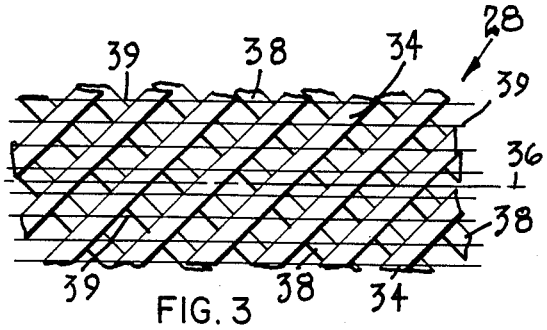
FIG. 3 is a top view of a double bias fabric in accordance with the present invention.
Figure 4:
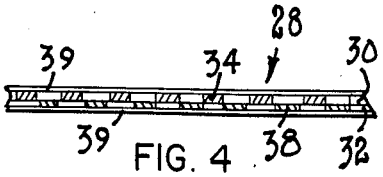
FIG. 4 is a side view of the fabric shown in FIG. 3.

FIGS. 3 and 4 illustrate a double bias fabric 28. Double bias fabric 28 is comprised of an upper layer single bias fabric 30 and a lower layer single bias fabric 32. Fabrics 30 and 32 may be the same as fabric 20. The structural yarn pieces 34 of fabric 30 are oriented at an acute angle with respect to centerline 36 while the structural yarn pieces 38 of fabric 32 are oriented at an obtuse angle with respect to centerline 36. Fabrics 30 and 32 are held in place with respect to one another by secondary yarn 39. Note that each fabric 30 and 32 has secondary yarn (not shown) equivalent to secondary yarn 24 in FIG. 1 for holding the structural yarn 34 and 38, respectively, in place with respect to the particular layer of fabric, while secondary yarn 39 holds the two fabrics 30 and 32 in place relative to each other. The double bias feature of fabric 28 provides significant structural strength in the two directions represented by the directions of structural yarn 34 and 38. Thus, although fabric 28 is thicker than fabric 20, it provides the significant advantage of increased structural strength in two directions as opposed to one.

Figure 5:
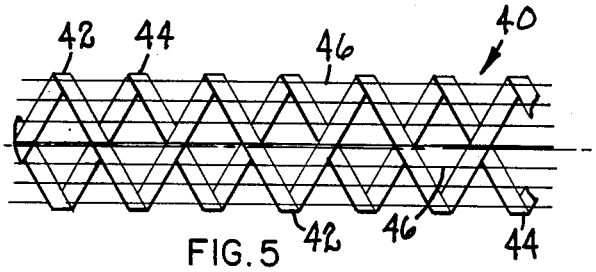
FIG. 5 is an alternate embodiment of a double bias fabric.
Figure 6:
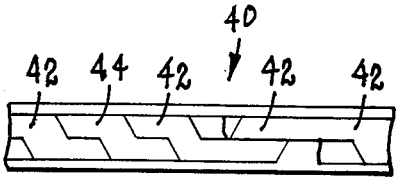
FIG. 6 is a side view of the fabric in FIG. 5.

Double bias fabric 40, as shown in FIGS. 5 and 6, has characteristics similar to fabric 28, but is constructed somewhat differently. The two biased layers of fabric 40 are not two individual fabrics, like fabrics 30 and 32 of fabric 28 in FIGS. 3 and 4. Rather, fabric 40 is comprised of continuous strands of structural yarn proceeding in a flattened helix form from approximately one end of fabric 40 to approximately the other end. For clarity, only two structural yarn strands 42 and 44 are shown in FIGS. 5 and 6. Note that in FIG. 6 a portion of strand 44 has been cut-away to show the opposite edge of structural yarn piece 42. Secondary yarn pieces 46 are sewn or knitted as described hereinbefore to hold structural yarn pieces 42 and 44 in place relative to one another. Ordinarily, a large plurality of structural yarn pieces, like 22, would proceed spirally from one end of fabric 40 to the other.

Figure 7:
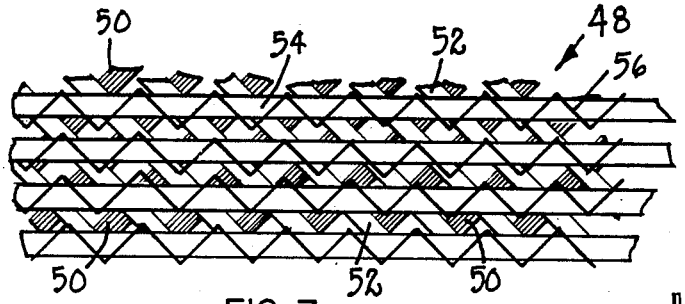
FIG. 7 is a top view of a triaxial fabric in accordance with the present invention.
Figure 8:
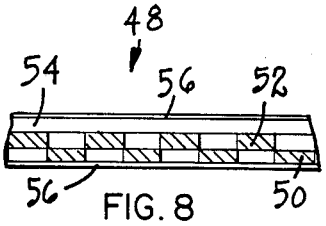
FIG. 8 is a side view of the fabric in FIG. 7.

A triaxial fabric 48 is shown in FIGS. 7 and 8. Triaxial fabric 48 is comprised of two fabric layers 50 and 52 and a third layer of uniaxial structural yarn 54. Layers 50 and 52 may be a fabric 40 as shown in FIGS. 5 and 6, a fabric 28 as shown in FIGS. 3 and 4 or two biased fabrics 20 as shown in FIGS. 1 and 2. Structural yarn pieces 54 are held in place with respect to layers 50 and 52 with secondary yarn 56. Secondary yarn 56 also holds layers 50 and 52 with respect to one another and with respect to uniaxial structural yarn 54. Secondary yarn 56 is ordinarily sewn with a tricot stitch, commonly known to those skilled in the art. Triaxial fabric 48 not only has the bi-directional strength characteristics of fabrics 28 and 40, but also has significant strength characteristics along a direction substantially parallel with the centerline 58 of the fabric 48.

It is to be understood that the bias angle of the structural yarn with respect to the centerline of the fabric may range through angles from zero to 180 degrees. It is recognized, however, that fabric having structural yarn at 90 degrees or zero degrees with respect to the centerline of the fabric has been known prior to the present invention. Although the single bias material 20 is but a small improvement over the prior art, the double bias material 28 and 40 and the triaxial material 48 are very significant improvements. It is to be further understood that the present invention contemplates a single bias material like 20 being stitched or knitted together with other known fabrics to create multiple layered fabrics thus providing the characteristics of the bias material to the composite fabric.

Figure 9:
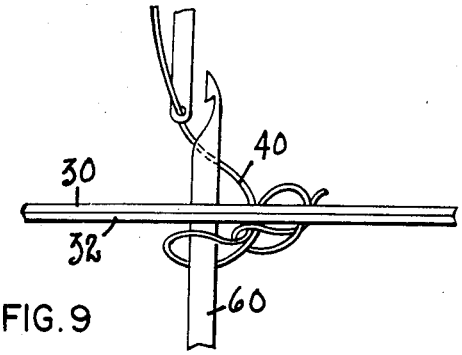
FIG. 9 is a side view of a double bias fabric being sewn together.

FIG. 9 illustrates two layers of biased fabric like 20 being sewn together with a chain-type stitch. The needle is illustrated at 60 creating the chain stitching with secondary yarn 40. The chain stitch is merely exemplary and could as well be a tricot stitch or some other stitch commonly known to those skilled in the art.

Figure 10:
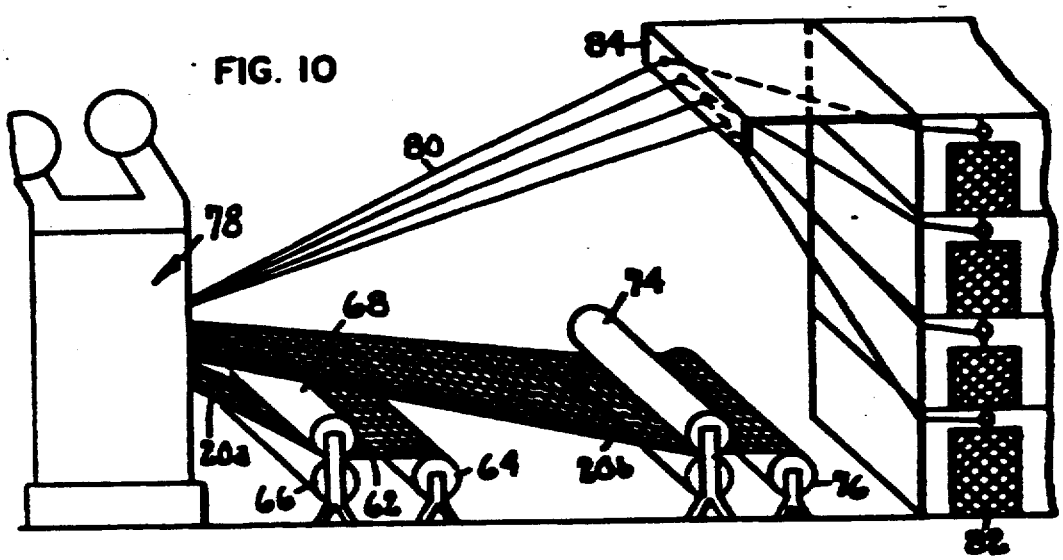
FIG. 10 is an illustration of the process used to fabricate a triaxial fabric.

Exemplary processes for making the fabrics which are in accord with the present invention are illustrated in FIGS. 10 and 11. FIG. 10 illustrates a method for making a triaxial fabric 48 like shown in FIGS. 7 and 8. A fabric 62 is pulled off a roll 64 by counter-rotating complimentary rollers 66 and 68. Roller 66 is immediately above roller 68. Fabric 62 is pressed and passes tightly between rollers 66 and 68. By properly tensioning rollers 66 and 68, the squeezing at a uniform rate between the rollers 66 and 68 can be utilized to change the direction of the continuous strand fabric 62, that is, from a fabric with structural yarn running either zero degrees or 90 degrees to the centerline of the fabric to a biased fabric 20*a*.

Figure 12:
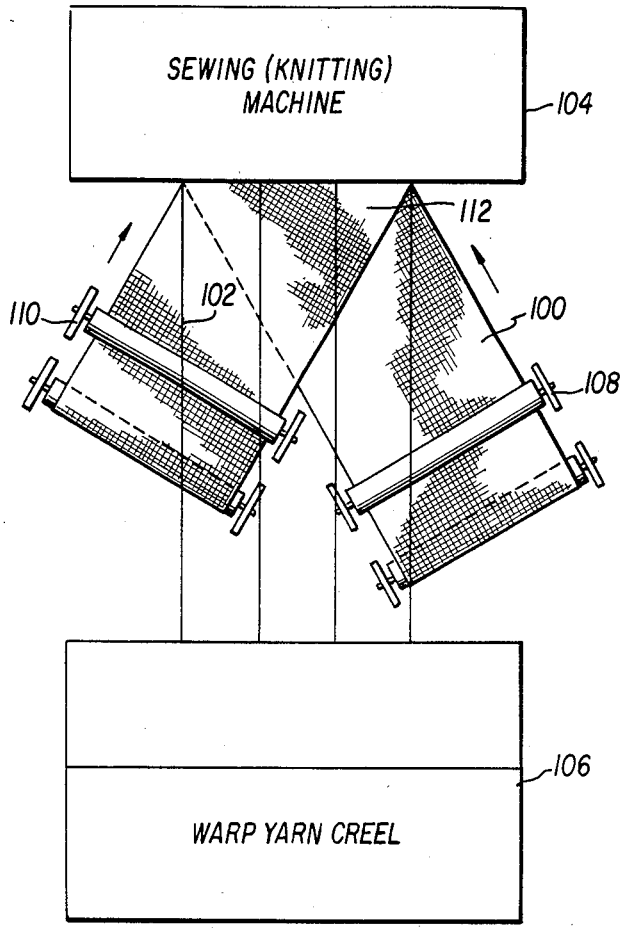
FIG. 12 is an overhead view of the process and apparatus illustrated in FIG. 10.

This is illustrated in overhead view in FIG. 12, wherein fabrics 100 and 112 are pulled off take up rolls through counter rotating pairs of rollers 108 and 110 into knitting machine 104 at a bias. Fibers 102 are pulled directly off warp yarn creel 106.

A second biased fabric 20*b* may be created by pressing it between a second set of rollers 72 and 74 as it is pulled from roll 76.

As biased fabrics 20*a* and 20*b* are fed one on top of the other into sewing machine 78, a plurality of structural yarn pieces 80 are laid parallel to the centerlines of the fabrics and on top of the upper fabric 20*b*. Structural yarns 80 are pulled by a mechanism (not shown) in the sewing machine from individual yarn reels 82. A guide mechanism 84 locates each yarn 80 with respect to the others. The three layers—lower biased fabric 20*a*, upper biased fabric 20*b* and the plurality of structural yarn pieces 80—are sewn, commonly with a tricot stitch, to form a fabric 48 as shown in FIG. 7.

A process illustrated in FIG. 11 may be used to create a double biased fabric 40 like shown in FIGS. 5 and 6. A plurality of structural yarn pieces 86 are pulled from individual rollers (not shown) in holder 88. The structural yarns 86 are threaded through openings 89 in guide member 90. A yarn carrier 92 is comprised of two carrier yarn chains 94 spaced-apart and substantially parallel with one another. Yarn catch elements 96 are regularly spaced along carrier yarn chains 94. Structural yarn 86 passes through the openings 89 in guide member 90 to catch elements 96 on the first yarn chain 94 nearest yarn storage holder 88. Yarn 86 is directed diagonally from guide member 90 to the first yarn chain 94. From the first yarn chain 94, yarn 86 is directed to the second yarn chain 94 at a different diagonal. This, of course, is accomplished by yarn carrier 90 moving reciprocally in one direction while yarn chains 94 move reciprocally in a 90 degree direction relative thereto. Ordinarily, the yarn between guide member 90 and first yarn chain 94 is directed at an angle of approximately 45 degrees from the yarn between yarn carrier 90 and yarn storage holder 88. Yarn 86 from the first yarn chain 94 to the second yarn chain 94 is directed at approximately 90 degrees from the yarn 86 between guide member 90 and the first yarn chain 94. Thus, as the yarn carrier 92 and the guide member 90 reciprocate, structural yarn 86 is formed into a flattened helix and directed into sewing machine 98 for appropriate stitching. The resulting fabric is a double bias fabric 40 like shown in FIGS. 5 and 6.

As indicated, the processes are merely representative of processes which could be used to create the various fabrics in accordance with the present invention. It is to be understood, therefore, that not only the fabrics, but also the processes which have been set forth in the disclosure, are illustrative only. Hence, any changes made, especially in matters of method, shape, size and arrangement, to the full extent extended by the general meaning of the terms in which the appended claims are expressed, are within the principle of the invention.

What is claimed is:

1. A method for making a multi-layer non-woven structural fabric comprising the steps of:

directing a first layer of structural fabric into a pair of counter-rotating rollers in contact with each other such that the longitudinal centerline of said first layer is substantially perpendicular to the longitudinal axis of the rollers, wherein said first layer of fabric is comprised of a plurality of substantially parallel structural fibers aligned parallel to said centerline of said fabric layer and a secondary holding means for maintaining said structural fibers in parallel alignment;

leading said first layer from said counter-rotating rollers into a stitching machine at an angle skewed from the original angle of orientation of the first fabric layer;

simultaneously leading a second layer of structural fabric comprised of a plurality of structural yarns substantially parallel to the centerline of said second layer and a secondary holding means for maintaining said structure fibers in parallel alignment into said stitching machine in a fashion such that the centerline of said second layer is substantially perpendicular to the transverse axis of said stitching machine; and stitching said first and second layers together in said stitching machine to provide a single structural fabric.

2. A method of making a multi-layer non-woven structural fabric comprised of the steps of:

directing a first layer of structural fabric into a pair of counter-rotating rollers in contact with each other such that the longitudinal centerline of said first layer is substantially perpendicular to the longitudinal axis of said rollers, wherein said first layer of fabric is comprised of a plurality of structural fibers aligned substantially parallel to said center line of said first layer and a secondary holding means for maintaining said structural fibers in parallel alignment;

leading said first layer from said counter-rotating rollers into a stitching machine at an angle skewed from said longitudinal axis of said first pair of counter-rotating rollers;

leading a second fabric layer into a second pair of counter-rotating rollers such that the centerline of said second fabric layer is substantially perpendicular to said second pair of counter-rotating rollers, wherein said second layer is comprised of a plurality of structural fibers aligned substantially parallel to the center line of said second fabric layer and means for maintaining said structural fibers of said second layer in parallel alignment;

leading said second fabric layer from said second pair of counter-rotating rollers into said stitching machine at an angle skewed from the longitudinal axis of said second pair of counter-rotating rollers; and stitching said layers together in said stitching machine to provide a single structural fabric.

3. A method for making a multi-layer non-woven fabric comprising the steps of:

directing a first layer of structural fabric into a pair of counter-rotating rollers in contact with each other such that the longitudinal centerline of said first layer is substantially perpendicular to the longitudinal axis of said rollers, wherein said first layer of fabric is comprised of a plurality of structural fibers aligned substantially parallel to said center line of said first layer and a secondary holding means for maintaining said structural fibers in parallel alignment;

leading said first layer from said counter-rotating rollers into a stitching machine at an angle skewed from said longitudinal axis of said first pair of counter-rotating rollers;

leading a second fabric layer into a second pair of counter-rotating rollers such that the centerline of said second fabric layer is substantially perpendicular to said second pair of counter-rotating rollers, wherein said second layer is comprised of a plurality of structural fibers aligned substantially parallel to the center line of said second fabric layer and means for maintaining said structural fibers of said second layer in parallel alignment;

leading said second fabric layer from said second pair of counter-rotating rollers into said stitching machine at an angle skewed from the longitudinal axis of said second pair of counter-rotating rollers;

leading a third layer of structural fabric comprised of a plurality of structural yarns substantially parallel to the centerline of said third layer into said knitting machine such that the centerline of said third layer is substantially perpendicular to the transverse axis of said knitting machine; and stitching said three layers together in said stitching machine to provide a single structural fabric.

4. The method of claim 1, wherein said secondary holding means is comprised of non-structural yarns.

5. The method of claim 2, wherein said secondary holding means for said first and second layers are comprised of nonstructural yarns.

6. The method of claim 3, wherein said secondary holding means for said first and second layers are comprised of nonstructural yarns.

7. The method of claim 2, wherein said skewed angle of said second fabric layer is different from said skewed angle of said first fabric layer.

8. The method of claim 3, wherein said skewed angle of said second fabric layer is different from said skewed angle of said first fabric layer.

9. A stitch-bonded multi-layer non-woven structural fabric comprised of first and second layers of structural fabric, said two fabric layers being comprised of substantially parallel structural yarns and secondary holding means to maintain said parallel alignment, wherein the structural fibers of each of said layers is aligned at an angle skewed from the centerline of said fabric, wherein said skewed angle of said first layer is not the negative of said skewed angle of said second layer.

10. The multi-layer non-woven structural fabric of claim 9, further comprising a third layer of structural fabric comprised of substantially parallel structural yarns maintained in parallel alignment by a secondary holding means, wherein said structural fibers of said third layer are substantially parallel to the centerline of said fabric.

11. The multi-layer non-woven structural fabric of claim 9, wherein said skewed angle of said first layer is 45 degrees.

12. The multi-layer non-woven structural fabric of claim 10, wherein the skewed angle of said first layer is 45 degrees.

13. The multi-layer non-woven structural fabric of claim 10, wherein the secondary holding means for each of said three layers is comprised of non-structural yarns.

* * * * *

UNITED STATES PATENT AND TRADEMARK OFFICE

CERTIFICATE OF CORRECTION

PATENT NO. : 4,567,738

DATED : February 4, 1986

INVENTOR(S) : HUTSON ET AL

It is certified that error appears in the above-identified patent and that said Letters Patent is hereby corrected as shown below:

Claim 1, line 9, change "parallel" to -- perpendicular --.

Claim 2, lines 9 and 22, change "parallel" to -- perpendicular --.

Claim 3, lines 9 and 22, change "parallel" to -- perpendicular --.

Signed and Sealed this

Thirty-first Day of May, 1988

*Attest:*

*Attesting Officer*

DONALD J. QUIGG

*Commissioner of Patents and Trademarks*

REEXAMINATION CERTIFICATE (1536th)

United States Patent [19]

Hutson et al.

[11] B1 4,567,738

[45] Certificate Issued Aug. 27, 1991

[54] STRUCTURAL FABRIC AND METHOD OF MAKING SAME

[75] Inventors: Harold K. Hutson; Ronald G. Krueger, both of Seguin, Tex.

[73] Assignee: Hexcel Corp., Minneapolis, Minn.

Reexamination Request:
No. 90/001,839, Aug. 14, 1989

Reexamination Certificate for:

| | |
|---|---|
| Patent No.: | **4,567,738** |
| Issued: | **Feb. 4, 1986** |
| Appl. No.: | **210,852** |
| Filed: | **Nov. 26, 1980** |

Certificate of Correction issued May 31, 1988.

[51] Int. Cl.[5] ..... D04B 23/10; D04B 23/06

[52] U.S. Cl. ..... 66/85 A; 26/51.3; 28/157; 66/84 A; 66/192; 112/440

[58] Field of Search ..... 66/84 R, 85 R, 85 A; 112/303, 305

[56] References Cited

U.S. PATENT DOCUMENTS

| | | | |
|---|---|---|---|
| 532,902 | 1/1895 | Palmer | 428/113 |
| 1,571,579 | 2/1926 | Duryea | 428/113 |
| 2,890,579 | 6/1959 | Mauersberger | 66/192 |
| 3,279,221 | 10/1966 | Gliksmann | 66/192 |
| 3,321,348 | 5/1967 | Rupp | 66/84 A X |
| 3,383,278 | 5/1968 | Helland | 26/51.3 |
| 3,422,511 | 1/1969 | Seguin | 28/101 X |
| 3,602,965 | 9/1971 | Burger | 28/101 |
| 3,607,565 | 2/1986 | Eaton | 28/100 X |
| 3,639,954 | 2/1972 | Kirzinger et al. | 28/102 |
| 3,756,043 | 9/1973 | Kemter | 66/84 R |
| 3,756,893 | 9/1973 | Smith | 156/440 |
| 3,819,461 | 6/1974 | Safadi | 66/193 X |
| 3,950,583 | 4/1976 | Patin | 28/101 X |
| 4,055,697 | 10/1977 | Schmanski | 26/51.3 X |
| 4,080,232 | 3/1978 | Fredrich | 28/101 |
| 4,189,811 | 2/1980 | Cole | 28/100 |

FOREIGN PATENT DOCUMENTS

| | | | |
|---|---|---|---|
| 912296 | 10/1972 | Canada | 66/84 A |
| 2224577 | 10/1974 | France . | |
| 2271326 | 12/1975 | France . | |
| 45-33874 | 10/1970 | Japan | 66/85 A |
| 50-35157 | 11/1975 | Japan | 28/157 |

*Primary Examiner*—Wm. Carter Reynolds

[57] ABSTRACT

A structural fabric (20, 28, 40, 48) and a method for making the same is disclosed. Structural fabric (20) is comprised of a plurality of substantially parallel, uniaxial structural yarn (22) and a secondary yarn (24) for holding the structural yarns (22) in place. The structural yarns (22) are oriented at an angle skewed from both the fabric centerline (26) and a line perpendicular to the faric centerline (26).

A double biased fabric (28) is made by sewing two fabrics (20) together with secondary yarn (39). An alternate double bias fabric (40) is made by sewing together with secondary yarn (46) the two layers of a flattened helix made from structural yarn (42, 44) running spirally substantially the length of the fabric (40).

A triaxial fabric (48) is made by sewing together with a secondary yarn (56) two single biased fabrics (50, 52) and a layer of longitudinally-extending structural yarn pieces (54).

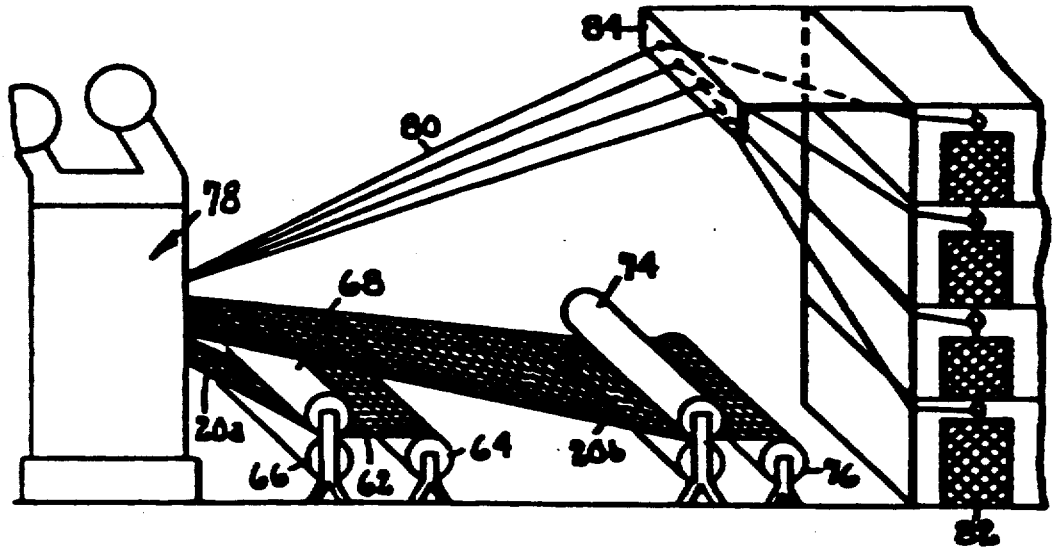

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, line 52–Column 4, line 4:

FIGS. 3 and 4 illustrate a double bias *stitch-bonded* fabric 28. Double bias fabric 28 is comprised of an upper layer single bias fabric 30 and a lower layer single bias fabric 32. Fabrics 30 and 32 may be the same as fabric 20. The structural yarn pieces 34 of fabric 30 are oriented at an acute angle with respect to centerline 36 while the structural yarn pieces 38 of fabric 32 are oriented at an obtuse angle with respect to centerline 36. Fabrics 30 and 32 are held in place with respect to one another by [secondary] *tertiary* yarn 39. Note that each fabric 30 and 32 has secondary yarn (not shown) equivalent to secondary yarn 24 in FIG. 1 *within each fabric layer only* for holding the structural yarn 34 and 38, respectively, in place with respect to the particular layer of fabric, while [secondary] *a tertiary* yarn 39 holds the two fabrics 30 and 32 in place relative to each other. The double bias feature of fabric 28 provides significant structural strength in the two directions represented by the directions of structural yarn 34 and 38. Thus, although fabric 28 is thicker than fabric 20, it provides the significant advantage of increased structural strength in two directions as opposed to one.

Column 4, lines 22–37:

A triaxial fabric 48 is shown in FIGS. 7 and 8. Triaxial fabric 48 is comprised of two fabric layers 50 and 52 and a third layer of uniaxial structural yarn 54. Layers 50 and 52 may be a fabric 40 as shown in FIGS. 5 and 6, a fabric 28 as shown in FIGS. 3 and 4 or two biased fabrics 20 as shown in FIGS. 1 and 2. Structural yarn pieces 54 are held in place with respect to layers 50 and 52 with [secondary] *tertiary* yarn 56. [Secondary] *Tertiary* yarn 56 also holds layers 50 and 52 with respect to one another and with respect to uniaxial structural yarn 54. [Secondary] *Tertiary* yarn 56 is ordinarily sewn with a tricot stitch, commonly known to those skilled in the art. Triaxial fabric 48 not only has the bi-directional strength characteristics of fabrics 28 and 40, but also has significant strength characteristics along a direction substantially parallel with the centerline 58 of the fabric 48.

Column 4, lines 53–58:

FIG. 9 illustrates two layers of biased fabric like 20 being sewn together with a chain-type stitch. The needle is illustrated at 60 creating the chain stitching with [secondary] *tertiary* yarn 40. The chain stitch is merely exemplary and could as well be a tricot stitch or some other stitch commonly known to those skilled in the art.

AS A RESULT OF REEXAMINATION, IT HAS BEEN DETERMINED THAT:

The patentability of claims 1 through 8 is confirmed.

Claim 13 is cancelled.

Claims 9 and 10 are determined to be patentable as amended.

Claims 11 and 12, dependent on an amended claim, are determined to be patentable.

9. A stitch-bonded multi-layer non-woven structural fabric comprised of [first and second layers of structural fabric] *a first layer of structural fabric and a second layer of structural fabric, each of* said two fabric layers being comprised of [substantially] parallel structural yarns and secondary holding [means] *yarns only within said fabric layer* to maintain said parallel alignment, wherein the structural [fibers] *yarns* of each of said layers [is] *are* aligned at an angle skewed from the center line of said fabric, wherein said skewed angle of said first layer is not the negative of said skewed angle of said second layer, *said first and second layers being bonded by additional tertiary yarns stitched therethrough.*

10. The multi-layer non-woven structural fabric of claim 9, further comprising a third layer of structural fabric comprised of [substantially] parallel structural yarns maintained in parallel alignment by [a secondary holding means] *said tertiary yarn*, wherein said structural [fibers] *yarns* of said third layer are substantially parallel to the centerline of said fabric.

* * * * *